US006165297A

United States Patent [19]

Smith et al.

[11] Patent Number: 6,165,297

[45] Date of Patent: Dec. 26, 2000

[54] PROCESS AND APPARATUS FOR THE MANUFACTURE OF EMULSION EXPLOSIVE COMPOSITIONS

[75] Inventors: Jeremy Guy Breakwell Smith, Eleebana; David Stow, Medowie, both of Australia

[73] Assignee: Orica Australia PTY LTD, Melbourne, Australia

[21] Appl. No.: 09/091,758

[22] PCT Filed: Dec. 24, 1996

[86] PCT No.: PCT/AU96/00838

§ 371 Date: Sep. 25, 1998

§ 102(e) Date: Sep. 25, 1998

[87] PCT Pub. No.: WO97/24298

PCT Pub. Date: Jul. 10, 1997

[30] Foreign Application Priority Data

Dec. 29, 1995 [AU] Australia ..... PN 7373

[51] Int. Cl.[7] ..... D03D 23/00; F42B 3/00

[52] U.S. Cl. ..... 149/109.6; 102/313

[58] Field of Search ..... 102/313; 149/2, 149/46, 60, 61, 109.6

[56] References Cited

U.S. PATENT DOCUMENTS

| | | | |
|---|---|---|---|
| 3,161,551 | 12/1964 | Egly . | |
| 3,288,658 | 11/1966 | Ferguson . | |
| 3,447,978 | 6/1969 | Bluhm . | |
| 3,610,088 | 10/1971 | Christensen . | |
| 3,617,401 | 11/1971 | Mortensen . | |
| 3,886,010 | 5/1975 | Thornley et al. | 149/60 |
| 4,111,741 | 9/1978 | Paul . | |
| 4,181,546 | 1/1980 | Clay . | |
| 4,248,644 | 2/1981 | Healy . | |
| 4,357,184 | 11/1982 | Binet . | |
| 4,500,369 | 2/1985 | Tag et al. | 149/2 |
| 4,711,678 | 12/1987 | Ehrnstrom | 149/2 |
| 4,764,230 | 8/1988 | Bates et al. | 149/21 |
| 4,822,433 | 4/1989 | Cooper . | |
| 4,960,475 | 10/1990 | Cranney et al. | 149/2 |
| 4,997,494 | 3/1991 | Nguyen | 149/2 |
| 5,084,117 | 1/1992 | Houston et al. | 149/2 |
| 5,160,387 | 11/1992 | Sujansky | 149/2 |
| 5,346,564 | 9/1994 | Vance et al. | 149/109.6 |
| 5,454,890 | 10/1995 | Evans et al. | 149/46 |
| 5,500,062 | 3/1996 | Chattopadhyay | 149/46 |

FOREIGN PATENT DOCUMENTS

| | | |
|---|---|---|
| 29408/71 | 5/1971 | Australia . |
| 40006/85 | 3/1985 | Australia . |
| 57045/90 | 12/1990 | Australia . |
| 79022/94 | 6/1995 | Australia . |
| 1 244 244 | 11/1988 | Canada . |
| 0 0252 625 A2 | 1/1988 | European Pat. Off. . |

OTHER PUBLICATIONS

Derwent WPAT Online AbstractAccession No. 88–31491/45, CN, A, 8602842 (Mining Res Inst) Oct. 28, 1987.

*Primary Examiner*—Charles T. Jordan
*Assistant Examiner*—Aileen J. Baker
*Attorney, Agent, or Firm*—Pillsbury Madison & Sutro LLP

[57] ABSTRACT

An apparatus and process for the manufacture of an emulsion explosive wherein the composition of emulsion explosive can be continually varied in a controlled manner. The apparatus comprises: (i) at least one mixing means suitable for blending components into an emulsion; (ii) at least one delivery means for delivering an emulsion explosive from said mixing means into a blasthole or package; (iii) at least one container for emulsion; (iv) at least two containers for components which on combination are suitable for forming a gas for the gassing emulsion; (v) optionally, further containers for optional components suitable for addition to the emulsion or emulsion explosive; (vi) supply means for the supply of said components from said containers to the mixing means; and (vii) control means for controlling the amount or rate of supply of components to the mixing means and thereby enabling the composition of the emulsion explosive to be continuously varied in a controlled manner.

25 Claims, No Drawings

PROCESS AND APPARATUS FOR THE MANUFACTURE OF EMULSION EXPLOSIVE COMPOSITIONS

This invention relates to a process and apparatus for the manufacture of explosives.

Civilian mining, quarrying and excavation industries commonly use bulk or packaged explosives as the principal sources of power for breaking rocks and ore for mining, building tunnels, excavating and similar activities.

The majority of emulsion explosives currently in use in these industries comprise non-explosive materials such as hydrocarbon fuels and water which are formed into emulsions and then sensitised to make them detonable emulsion explosives. In most countries emulsion explosives have virtually replaced nitroglycerine based explosives.

In the mining industry, rock is commonly fractured by drilling blastholes then filling them with bulk or packaged emulsion explosives which are subsequently detonated. Emulsion explosives are supplied to users in either bulk form or packaged in cartridges or bags.

Packaged emulsion explosives are manufactured and packaged at factories and transported to the site at which they are to be used and loaded into blastholes by hand. Packaged emulsion explosives are significantly more expensive than bulk emulsion explosives and tend to be preferred for small scale applications or for use in wet blastholes where the packaging prevents moisture ingress and concomitant degradation of the emulsion explosives. Conversely bulk emulsion explosives are preferred for large scale applications such as large mine sites where many hundreds of tonnes of explosives may be needed for a single blast. Bulk explosives are either manufactured and sensitised at a manufacturing factory and transported in a specially designed truck to the site of use or mixed on-site in manufacturing units located on trucks (called mobile manufacturing units or MMU's).

MMU's are effectively explosive factories on wheels. Each MMU is designed and built to produce and deliver specified bulk emulsion explosive from a manufacturing unit based on a conventional truck chassis. MMU's are able to carry to a mine site large quantities of precursors for manufacture of emulsion explosives on the mine bench. The precursors include materials such as unsensitised emulsion, particulate oxidiser salts and sensitising agents such as glass microballoons which materials are non-explosive and can be safely transported on public roads. Because the MMU's do not transport emulsion explosives per se, there is no need for compliance with the strict legislative requirements applied to transport of emulsion explosives. It is only when the unsensitised emulsion is combined with sensitising agents at the mine bench that an emulsion explosive is formed.

The transport trucks and MMU's are provided with mechanised means for loading bulk emulsion explosives into blastholes at high discharge rates; the loading is usually carried out by either auguring, pouring, pumping or pneumatically blowing emulsion explosives into blastholes. The method used depends on the type of product and the size of the blasthole to be filled. The larger transport trucks and MMU's are designed to deliver hundreds of tonnes of emulsion explosives in a single run at a loading rate of between 70 and 1000 kg per minute.

Most of the emulsion explosives in common use are based on water-in-oil emulsions. These formulations were first disclosed in U.S. Pat. No. 3,447,978 (Bluhm) and comprise as components:

(a) a discontinuous aqueous phase comprising discrete droplets of an aqueous solution of inorganic oxygen-releasing salts:

(b) a continuous water-imiscible organic phase throughout which the droplets are dispersed:

(c) an emulsifier which forms an emulsion of the droplets of oxidiser salt solution throughout the continuous organic phase; and optionally (d) a discontinuous gaseous phase and/or closed cell void material.

In some emulsion explosive compositions the water content in the oxidiser phase may be reduced to very low levels, for example less than 4%. Formulations in which water has been eliminated from the oxidiser phase are called melt-in-oil emulsion explosives and have been described in many patent specifications such as U.S. Pat. No. 4,248,644. The term emulsion as used herein refers to water-in-oil emulsions and melt-in-oil emulsions.

Emulsion explosives are often blended with a solid particulate oxidiser salt such as ammonium nitrate (AN) prills or particles, which may be coated with or contain fuel oil (FO) to form a low cost explosive of excellent blasting performance. Such compositions are described in Australian Patent Application no. 29408/7071 (Butterworth) and U.S. Pat. Nos. 3,161,551 (Egly et al), 4,111,727 (Clay), 4,181,546 (Clay) and 4,357,184 (Binet et al).

In emulsion explosives, emulsifiers are used to decrease interfacial tension between the aqueous and oil phases. Molecules of the emulsifier locate at the interface between the aqueous droplet and continuous hydrocarbon phase. The emulsifier molecules are oriented with the hydrophilic head group in the aqueous droplet and the lipophilic tail in the continuous hydrocarbon phase. Emulsifiers stabilise the emulsion, inhibiting coalesence of the aqueous droplets and phase separation. Emulsifiers also inhibit crystallisation of oxidiser salt in the aqueous droplets which crystallisation can lead to emulsion breakdown and reduction in detonation sensitivity of the emulsion explosive composition.

A variety of emulsifier types and blends are known in the art. For example Australian Patent no. 40006/85 (Cooper & Baker) discloses water-in-oil emulsion explosives which contain a conductivity modifier which may also act as an emulsifier. Included among such conductivity modifiers are condensation products of poly[alk(en)yl] succinic anhydride with amines such as ethylene diamine, diethylene triamine and ethanolamine.

Such conductivity modifiers/emulsifiers enable the preparation of particularly stable emulsions which are suitable for blending with solid particulate oxidiser salts such as ammonium nitrate (AN) or ammonium nitrate and fuel oil blends (ANFO). The stability of emulsion explosives prepared using such poly[alk(en)yl] succinic anhydride derivatives as conductivity modifiers/emulsifiers enables the preparation of unsensitised emulsion at a dedicated plant under controlled conditions and transport of the unsensitised emulsion for sensitisation to form an emulsion explosive.

In general emulsions cannot be detonated until they are sensitised to form an emulsion explosive. In the past, sensitising was sometimes carried out by mixing the unsensitised emulsion with a high explosive such as trinitrotoluene or nitroglycerine. Sensitising using high explosives has been virtually superseded by sensitisation methods which utilise non-explosive sensitising agents. For example it is now very common to sensitise an emulsion by incorporating small voids into the emulsion which act as hot spots for propagating detonation.

The most common methods currently used to incorporate voids and sensitise an emulsion or emulsion/AN/ANFO blend include in situ gassing using chemical agents, entrainment of air, the incorporation of closed cell void material such as microballoons or a mixture of all three.

Suitable chemicals for the in situ generation of gas bubbles suitable for use in emulsion explosives include peroxides such as hydrogen peroxide, nitrite salts such as sodium nitrite, nitrosamines such as N,N'-dinitrosopentamethylenetetramine, alkali metal borohydrides such as sodium borohydride and bases such as carbonates including sodium carbonate.

Perhaps the most widely used chemicals for the in situ generation of gas bubbles are nitrous acid and its salts which react under conditions of acid pH to produce nitrogen gas bubbles. Accelerators such as thiocyanate salts, iodides, sulphanic acid or its salts or thiourea may be used to accelerate the reaction of a nitrite gassing agent. The accelerator may also be consumed in the reaction.

In the past, sensitisation of emulsions to form emulsion explosives has been carried out by forming a gasser composition by dissolving appropriate chemicals in a solvent than mixing the gasser composition into an emulsion. The chemicals in the droplets of dispersed gasser composition in the emulsion would then react to form a gas which would disperse and nucleate in the emulsion to form gas bubbles.

Both MMU's and fixed manufacturing facilities store relatively large quantities of non-explosive chemical components for use in forming emulsion explosives. For example, MMU's and fixed plants comprise large storage containers for storing fuel oil, unsensitised emulsion, oxygen releasing salt solution, water, gasser solutions and other explosives components. Each manufacturing run of an MMU or a fixed plant may be of many hours in duration and a single composition of emulsion explosive is produced. At the start of each run, the flow of components from each of the storage containers is calibrated and the component flow rates set so that when the various streams of components are mixed, the desired composition of emulsion explosive is produced. At the end of the run the manufacturing pathways in the MMU or fixed plant are cleaned out in preparation for the next manufacturing run.

One of the problems associated with the above described emulsion explosive manufacturing process is that in general, there is very limited scope for producing more than one composition in a single manufacturing run. This relative inflexibility of existing emulsion explosive manufacturing facilities is a particular drawback with respect to MMU production runs.

MMU's are often despatched to mine sites which have varied physical and geological characteristics across the mine bench. This is particularly true of very large mine sites where the mine bench may be hundreds of meters in length and width. The blastholes may vary greatly in depth, wetness, wall composition and soforth. Some of the blastholes may be located in geothermal ground, that is ground which is extremely hot due to volcanic or other activity in the earth's crust. Some of the blastholes may be located in ground which comprises mineral species which tend to react with chemical components of certain emulsion explosives. It is extremely important in the case of geothermal ground or reactive ground that the blastholes be loaded with emulsion explosives which do not explode unexpectedly due to the influence of heat or due to reaction with the walls of the blasthole. Such blastholes should be loaded with emulsion explosive which meets the particular characteristics of the blasthole, which may means that the composition of the emulsion explosive need to be varied not only from blasthole to blasthole but also within a single blasthole.

Blastholes which are loaded with an emulsion explosive which does not meet the particular characteristics of the blasthole may fail to detonate, only partially detonate or as described above, blasthole walls may react with the emulsion explosive causing it to detonate unexpectedly. Using current MMU production methods, there is little scope for tailoring the composition or physical characteristics of the emulsion explosive produced by the MMU to individual blastholes or within a blasthole. Often several MMU's, each manufacturing a different product must be utilised at a single mine site.

It has now been found that a greater flexibility of process operation and concomitantly a much larger range of formulations can be manufactured on fixed and mobile manufacturing units than has hitherto been available, through an improved apparatus and method of gassing emulsions. The improved apparatus and method of manufacture of emulsion explosives provides a system which permits more rapid change from production of one formulation/product to another formulation/product than has hitherto been possible.

The current invention therefore provides an apparatus for the manufacture of an emulsion explosive wherein the composition of the emulsion explosive can be continually varied in a controlled manner, which apparatus comprises;

(i) at least one mixing means suitable for blending components into an emulsion;

(ii) at least one delivery means for delivering an emulsion explosive from said mixing means into a blasthole or package;

(iii) at least one container of emulsion;

(iv) at least two containers for components which on combination form a gas for gassing said emulsion;

(v) optionally, further containers for optional components suitable for addition to the emulsion;

(vi) supply means for the supply of said components from said containers to said mixing means; and (vii) control means for controlling the amount or rate of supply of components to said mixing means and thereby enabling the composition of the emulsion explosive to be continuously varied in a controlled manner.

The current invention also provides a process for the manufacture of an emulsion explosive which process enables the composition of the emulsion explosive to be varied in a controlled manner in order to meet the different compositional requirements within blastholes and between blastholes which process comprises mixing an emulsion with at least two components which on combination form a gas for gassing the emulsion and further optional components in an apparatus comprising:

(i) at least one mixing means suitable for blending components into an emulsion;

(ii) at least one delivery means for delivering an emulsion explosive from said mixing means into a blasthole or package;

(iii) at least one container for an emulsion;

(iv) at least two containers for components which on combination form a gas for gassing said emulsion;

(v) optionally, further containers for optional components for addition to the emulsion;

(vi) supply means for the supply of said components from said containers to said mixing means; and (vii) control means for controlling the amount or rate of supply of components to said mixing means and thereby enabling the composition of the emulsion explosive to be continuously varied in a controlled manner.

Where used herein the term "emulsion" refers to an unsensitised or partially sensitised emulsion suitable for use as a precursor for an emulsion explosives composition and includes water-in-oil emulsions, melt-in-oil emulsions, oil-in-water emulsions and the like. The term "emulsion explosive" refers to a sensitised emulsion explosive which is detonable.

It has been found that the apparatus and process of the present invention may be used to prepare emulsion explosives, the properties of which may be sufficiently rapidly changed such that the composition of the emulsion explosive may be varied within a blasthole and potentially each blasthole can be loaded with a different emulsion explosive formulation. This provides significant advantages at large mine sites which may have groups of blastholes exhibiting different characteristics. For example some of the holes may be located in reactive ore, some in unreactive ore, some in wet areas and some in dry areas. The apparatus of the current invention may be made by modifying an existing MMU so that a single MMU visiting such a mine bench may load wet holes with a water resistant explosive, dry holes with emulsion explosives suitable for dry-hole use and blastholes in reactive ground with emulsion explosives comprising a component to inhibit premature reaction.

Apart from the aforementioned variation of inter-blasthole composition, the apparatus and process of the current invention may be used to provide variation of intra-blasthole composition. For example blastholes may be loaded with low density emulsion explosives at the toe, the density of the emulsion explosive increasing towards the collar to compensate for the effects of the varying hydrostatic head.

Similarly, it may be desirable to vary the formulation of an emulsion explosive within a blasthole so that different amounts of energy are released along the length of the blasthole. This may be of particular advantage for blastholes which are partly drilled through hard rock such as basalt and partly drilled through soft or porous rock such as scoria or sandstone. It may be advantageous to have the hard rock in contact with emulsion explosive of higher shatter, low heave energy profile and the soft rock in contact with emulsion explosive having a low shatter, high heave energy profile. The apparatus and method of the current invention may be used to not only vary the quantity and composition of gasser composition but also for adding further components such as salts (for forming permitted explosives), anti-fume species (for forming low fume explosives), species which suppress reaction or breakdown of the explosive composition in the blasthole and pH buffer.

The apparatus and method of the current invention may also provide advantages in the loading of very deep blastholes such as those around 30 or 50 meters or more in depth. Deep blastholes are often relatively cool at the collar but increase in temperature as they extend into the earth. Preferably the emulsion explosive loaded into such blastholes has a composition which is varied to provide increasing temperature tolerance towards the toe of the blasthole. Furthermore, because gassing rate of an emulsion explosive is affected by temperature, it may also be advantageous to load a very deep blasthole with a fast gassing emulsion explosive composition at the collar and varying the emulsion composition along the length of the blasthole so that the gassing rate is decreased towards the toe.

The current process and apparatus of the present invention may also be advantageous in compensating for different emulsion temperatures encountered. For example, an emulsion manufactured at 65° C. may be loaded into an MMU but over time the emulsion temperature may drop to ambient temperature, nominally 25° C. As gassing rate varies with emulsion temperature, if the amount or rate of addition of component such as catalyst and/or accelerator cannot be varied, then the rate of gassing cannot be controlled. The method of the current invention may provide for variation of the rate of addition of components which react to form a gas in order to compensate for changes in temperature of the emulsion. Preferably the quantity of catalyst or accelerator added to the gasser stream will vary from 0.05 wt % of the gasser composition for hot emulsions to 20% of the gasser composition for cold emulsions. The addition of other components may also be varied in response to the emulsion temperature. Depending on the emulsion explosive product to be manufactured, emulsion may be purposely kept at any temperature between about 65° C. and about 10° C. and the current invention may be used to accommodate the emulsion temperature.

The apparatus and method of the current invention may be used to compensate for variations in local temperature. For example the ambient temperature when emulsion explosives are manufactured in Western Australia may be as high as 50° C. while in Tasmania the ambient temperature may be close to zero. There are clearly advantages in being able to tailor the explosive composition to compensate or allow for variations in temperature of individual emulsion explosive components and the ambient or operating temperature.

The rates and manner in which the components are supplied and mixed into an emulsion to form an emulsion explosive may have a profound effect on the nature of the end product.

Changing the relative proportions of components which react to form a gas is a particularly effective way of varying the overall emulsion explosive composition/characteristics and thus tailoring the composition of the emulsion explosive to the requirements of individual blastholes. The components which combine to form a gas are preferably premixed before being incorporated into the emulsion. Control of the flow of individual components which combine to form a gas allows an enormous number of different gas forming combinations or compositions to be formed; because very small volumes of components are involved, new gas forming combinations or compositions can be attained very quickly upon alteration of reagent flow rates. Small changes in component flow rates can cause large changes in the rate of gas formation and the number and volume of gas bubbles formed. Concomitantly the chemical composition and/or physical properties of the emulsion explosive into which the components are mixed can be rapidly changed. This provides a considerable advantage over the prior art where mobile and fixed manufacturing plants used only a single storage container of pre-prepared gasser composition.

One of the most commonly used gasser compositions of the prior art comprises an aqueous solution of inorganic nitrite, ammonium species and accelerator. Acid pH of the emulsion explosive causes reaction of the nitrite species to form nitrogen gas. The concentration of acid species or accelerator present determines the rate of nitrite reaction and gas generation. Using the method of the current invention, the flow rate and thus relative proportions of components such as nitrite, accelerator and acid species present in the emulsion explosives can be varied to produce different gas production rates. With some combinations of components it may be possible to add each component directly from the storage facilities to the emulsion explosive being manufactured to provide a satisfactory gas production rate and gassed emulsion. However, depending on the components utilised it may be preferably to form a premix of certain components. The apparatus of the current invention may comprise a means for combining some or all of the components to form a premix for gassing the emulsion. The means for combining the components may be a mixing chamber or an area of turbulence formed by the combination of two or more streams of individual components or mixtures of gasser components. Each stream may comprise one or more components in liquid or solution form.

Formation of a premix is particularly preferred where the components comprise an inorganic nitrite, ammonium species and accelerator because adding each component individually to the emulsion explosive may not provide a sufficiently rapid gassing reaction and may lead to unwanted reactions which cause deterioration of the emulsifier and emulsion. Furthermore the three components cannot be kept together in a storage facility for extended periods of time because the components slowly react and self gas. The current invention can overcome this problem by providing for the separate storage of the inorganic nitrite, ammonium species and accelerator and forming a premix just prior to addition to the emulsion. Alternatively the accelerator may be stored in combination with either the inorganic nitrate and/or the ammonium species prior to formation of the premix.

In addition the emulsion of the current invention may be sensitised by other convenient means including addition of glass or plastic microballoons, entrainment of gas or combinations thereof. For example components which react to form a gas may be mixed into emulsion which has already been partially sensitised by addition of glass microballoons.

Where the components which react to form a gas in the process of the current invention comprises an ammonium species the ammonium species may be any suitable source of ammonium known to those skilled in the art, such as ammonia, primary or secondary amines and the salts thereof. Suitable ammonium salts include ammonium chloride, ammonium nitrate, ammonium chlorate, ammonium sulphate, ammonium perchlorate, ammonium thiocyanate and combinations thereof. The ammonium species may be formed in situ in the gasser solution droplet, for example by the reaction of ammonia or a primary or secondary amine with a mineral acid or organic acid. The ammonium species may typically comprise up to 25 wt % of the gasser composition.

Where the components which react to form a gas in the process of the current invention comprises an inorganic nitrite, the inorganic nitrite may be any suitable nitrite known to those skilled in the art such as an alkaline earth nitrite, alkali metal nitrite or combinations thereof. In a particularly preferred embodiment the inorganic nitrite is sodium nitrite. Preferably the inorganic nitrite comprises up to 25 wt % of the gasser.

Where the components which react to form a gas in the process of the current invention comprises an accelerator or catalyst, the accelerator or catalyst may be any accelerator appropriate for the particular gasser being used. Where the components comprises an inorganic nitrite and an ammonium species, the accelerator may be thiourea, thiocyanate, iodide, cyanate, acetate or the like and combinations thereof. The proportion of accelerator or catalyst in the total combination of components for forming a gas may be influenced by the solubility of the accelerator but would commonly comprise up to 25 wt % of the gasser. In a particularly preferred embodiment the combination of components for forming a gas comprises an inorganic nitrite, optionally an ammonium species and up to 3 wt % of thiourea or thiocyanate as accelerator.

The pH of the combination of components for forming a gas is preferably between pH 5 and 9 and more preferably between pH 6 and 8. the pH of the emulsion may also be buffered to a pH of between pH 5 and pH 9.

The combination of components for forming a gas may comprise any suitable solvent including alcohols but water is the preferred solvent. Other optional additives may also be present.

Suitable oxygen releasing salts for use in the water-in-oil emulsion of the present invention include the alkali and alkaline earth metal nitrates, chlorates and perchlorates, ammonium nitrate, ammonium chlorate, ammonium perchlorate, and mixtures thereof. The preferred oxygen releasing salts include ammonium nitrate, sodium nitrate and calcium nitrate. More preferably the oxygen releasing salt comprises ammonium nitrate or a mixture of ammonium nitrate and sodium or calcium nitrates.

Typically, the oxygen releasing salt component of the compositions of the present invention comprise from 45 to 95 wt % and preferably from 60 to 90 wt % of the total emulsion composition. In compositions wherein the oxygen releasing salt comprises a mixture of ammonium nitrate and sodium nitrate the preferred composition range for such a blend is from 5 to 80 parts of sodium nitrate for every 100 parts of ammonium nitrate. Therefore, in the preferred composition the oxygen releasing salt component comprises from 45 to 90 wt % (of the total emulsion composition), ammonium nitrate or mixtures of from 0 to 40 wt %, sodium or calcium nitrates and from 50 to 90 wt % ammonium nitrate.

Typically the amount of water employed in the compositions of the present invention is in the range of from 0 to 30 wt % of the total emulsion composition. Preferably the amount employed is from 4 to 25 wt % and more preferably from 6 to 20 wt %.

The water immiscible organic phase of the emulsion composition of the present invention comprises the continuous "oil" phase of the emulsion composition and is the fuel. Suitable organic fuels include aliphatic, alicyclic and aromatic compounds and mixtures thereof which are in the liquid state at the formulation temperature. Suitable organic fuels may be chosen from fuel oil, diesel oil, distillate, furnace oil, kerosene, naphtha, waxes such microcrystalline wax, paraffin wax, and slack wax, paraffin oils, benzene, toluene, xylenes, asphaltic materials, polymeric oils such as the low molecular weight polymers of olefins, animal oils, fish oils and other mineral, hydrocarbon or fatty oils, and mixtures thereof. Preferred organic fuels are liquid hydrocarbons generally referred to as petroleum distillates such as gasoline, kerosene, fuel oils and paraffin oils.

Typically the organic field or continuous phase of the emulsion comprises from 2 to 15 wt % and preferably 3 to 10 wt % of the total composition.

The emulsifier of the emulsion composition of the present invention may comprise emulsifiers chosen from the wide range of emulsifiers known in the art for the preparation of emulsion explosive compositions. It is particularly preferred that the emulsifier used in the emulsion composition of the present invention is one of the well known emulsifiers based on the reaction products of poly[alk(en)yl] succinic anhydrides and alkylamines, including the polyisobutylene succinic anhydride (PiBSA) derivatives of alkanolamines. Other suitable emulsifiers for use in the emulsion of the present invention include alcohol alkoxylates, phenol alkoxylates, poly(oxyalkylene)glycols, poly(oxyalkylene) fatty acid esters, amine alkoxylates, fatty acid esters of sorbitol and glycerol, fatty acid salts, sorbitan esters, poly (oxyalkylene) sorbitan esters, fatty amine alkoxylates, poly (oxyalkylene) glycol esters, fatty acid amines, fatty acid amid alkoxylates, fatty amines, quaternary amines, alkyloxazolines, alkenyloxazolines, imidazolines, alkylsulphonates, alkylarylsulphonates, alkylsulphosuccinates, alkylarylsulphonates, alkylsulphossuccinates, alkylphosphates, alkenylphosphates, phosphate esters, lecithin, copolymers of poly(oxyalkylene)glycols and poly(12-hydroxystearic) acid, and mixtures thereof.

Amongst the preferred emulsifiers are the 2-alkyl and 2-alkenyl-4,4'-bis(hydroxymethyl)oxazoline, the fatty acid esters of sorbitol, lecithin, copolymers of poly(oxyalkylene) glycols and poly(12-hydroxystearic acid) and mixtures thereof and particularly sorbitan mono-oleate, sorbitan sesquioleate,2-oleyl-4,4'bis(hydroxymethyl)oxazoline, mixtures of sorbitan sesquioleate, lecithin and a copolymer of poly(oxyalkylene)glycol and poly(1-hydroxystearic acid) and mixtures thereof. Where used, particularly preferred additional emulsifiers include sorbitan esters such as sorbitan mono-oleate.

Typically the emulsifier of the emulsion comprises up to 5 wt % of the emulsion. Higher proportions of the emulsifying agent may be used and may serve as supplemental fuel for the composition but in general it is not necessary to add more than 5 wt % of emulsifying agent to achieve the desired effect. Stable emulsions can be formed using relatively low levels of emulsifier and for reasons of economy it is preferably to keep the amount of emulsifying agent used to the minimum required to form the emulsion. The preferred level of emulsifying agent used is in the range of from 0.1 to 2.0 wt % of the water-in-oil emulsion.

If desired, other optional fuel materials, hereinafter referred to as secondary fuels may be incorporated in to the emulsion in addition to the water immiscible organic fuel phase. Examples of such secondary fuels include finely divided solids and water miscible organic liquids which can be used to partially replace water as a solvent for the oxygen releasing salts or to extend the aqueous solvent for the oxygen releasing salts. Examples of solid secondary fuels include finely divided materials such as sulphur, aluminium, urea and carbonaceous materials such as gilsonite, comminuted coke or charcoal, carbon black, resin acids such as abietic acid, sugars such as glucose or dextrose and vegetable products such as starch, nut meal, grain meal and wood pulp. Examples of water miscible organic liquids include alcohols such as methanol, glycols such as ethylene glycol, amides such as formamide and urea and amides such as methylamine.

Typically the optional secondary fuel component of the composition of the present invention comprises from 0 to 30 wt % of the total composition.

The water-in-oil emulsion composition may be prepared by a number of methods. One preferred method of manufacture includes; dissolving said oxygen releasing salts in water at a temperature above the fudge point of the salt solution, preferably at a temperature in the range from 20 to 110° C. to give an aqueous salt solution; combining an aqueous salt solution, a water immiscible organic phase, and an emulsifier with rapid mixing to form a water-in-oil emulsion; and mixing until the emulsion is uniform.

It lies within the invention that there may also be incorporated into the emulsion other substances or mixtures of substances which are oxygen releasing salts or which are themselves suitable as explosive materials. For example the emulsion may be mixed with prilled or particulate ammonium nitrate or ammonium nitrate/fuel oil mixtures before or after the emulsion has been gassed.

Other optional additives may also be added to the emulsion explosive compositions hereinbefore described including thickening agents and thickener crosslinking agents such as zinc chromate or a dichromate either as a separate entity or as a component of a conventional redox system such as for example, a mixture of potassium dichromate and potassium antimony tartrate.

The apparatus of the current invention may be made by modifying an existing MMU. Such as MMU's of the type described in Australian patent no. 42838/85. For example, apart from the storage facilities for the individual gasser composition components the MMU's may be modified to include sufficient comprise storage facilities for oxygen releasing salt prills or particles, oxygen releasing salt solution, emulsion, fuel oil, chemical additives and the like. The components may be moved from the storage facilities by various mechanised means such as augers and pumps and may be mixed together by any convenient means such as pinmills, static mixing elements and the like. Process monitoring may be carried out by any convenient means known in the art such as rpm counters, flow rate sensors, hydraulic pressure sensors and electronic detectors.

The invention is now demonstrated by but in no way limited to the following examples.

EXAMPLE 1

Preparation of a PiBSA Based Water-in-Oil Emulsion

A water-in-oil emulsion of the following composition was prepared for use in the following examples:

| | |
|---|---|
| Oxidiser Solution | 90 wt % comprising:<br>ammonium nitrate (78.9 wt %)<br>water (20.7 wt %)<br>buffer (0.4 wt %) |
| Fuel Phase | 9 wt % comprising a hydrocarbon oil/emulsifier mix. |

The emulsifier was an uncondensed amide form of the reaction product of an alkanolamine and poly(isobutylene) succinic anhydride (PiBSA). The emulsion was prepared by dissolving ammonium nitrate in the water at elevated temperature (98° C.) then adjusting the pH of the oxidiser solution so formed to 4.2. The fuel phase was then prepared by melting the microcrystalline wax and mixing it with the hydrocarbon oil/emulsifier mix. The oxidiser phase was then added in a slow stream to the fuel phase at 98 °C. with rapid stirring to form a homogeneous water-in-oil emulsion.

Gas Forming Components and Addition to the Water-in-Oil Emulsion

The following components in aqueous solution were combined to provide the following gas forming composition;

Thiourea 3.0 wt % sodium nitrite 6.9 wt % ammonium nitrate 8.0 wt % water 82.1 wt %

The level of addition of the gas forming composition to the water-in-oil emulsion was 0.5 wt %. The apparatus of the current invention was made by modifying an MMU to comprise a mixing means for blending components into an emulsion, a hose for delivering an emulsion explosive into blastholes, an emulsion container, two containers for components which on combination form a gas, conduits for supplying the contents of the containers to the mixing means and control devices for controlling the amount and rate of supply of the components in containers to the mixing means. The containers of the apparatus comprised polypropylene or stainless steel tanks.

An aqueous solution of the sodium nitrite (SNI) was stored in one polypropylene tank of the apparatus of the current invention while an aqueous solution of the ammonium nitrate (AN) and thiourea was stored in a separate polypropylene tank. The water-in-oil emulsion was stored in a large volume stainless steel tank and was mechanically pumped from the tank through a series of stainless steel conduits on the MMU. The SNI solution and AN/thiourea solution were pumped from their containers through separate conduits which eventually joined to form a single conduit. The turbulence caused by the two streams of solution meeting to form a single stream caused through mixing of the AN, SNI and thiourea. The single stream of mixed components was then pumped into the water-in-oil emulsion just prior to the water-in-oil emulsion passing through a series of static mixing elements which evenly distributed the components throughout the water-in-oil emulsion. The water-in-oil emulsion incorporating the mixed components for forming a gas, passed through the remaining length of stainless steel conduit into a flexible loading hose, the other end of which was located in a blasthole.

The blasthole was filled with the combination of water-in-oil emulsion and mixed components. The components started to react to form gas after about 30 seconds and it took about 30 minutes for the gassing reaction to be completed. The density of the gassed water-in-oil emulsion was 1.08 g/cc compared with 1.38 g/cc for the ungassed water-in-oil emulsion. The blasthole detonated successfully.

EXAMPLE 2

The method of forming a gassed emulsion explosive described in Example 1 was repeated using the same components for forming a gas and the same apparatus, the apparatus in this case having three containers for components suitable for forming a gas. The gassing method differed from Example 1 in that aqueous solution of the sodium nitrite (SNI), an aqueous solution of thiourea and an aqueous solution of the ammonium nitrate (AN) were stored in three separate containers. The SNI solution, thiourea solution and AN solution were pumped from their containers through three separate conduits which eventually joined to form a single conduit. The turbulence caused by the three streams of solution meeting to form a single stream caused thorough mixing of the AN, SNI and thiourea. The single stream of mixed components was then pumped into the water-in-oil emulsion just prior to the water-in-oil emulsion passing through a series of static mixing elements which evenly distributed the components throughout the water-in-oil emulsion. The water-in-oil emulsion incorporating the components passed through the remaining length of stainless steel conduit into a flexible loading hose, the other end of which was located in a blasthole.

The blasthole was filled with the combination of water-in-oil emulsion and mixed components. The mixed components started to react after about 30 seconds and it took about 30 minutes for the gassing reaction to be completed. The density of the gassed water-in-oil emulsion was 1.08 g/cc compared with 1.38 g/cc for the ungassed water-in-oil emulsion. The blasthole detonated successfully.

EXAMPLE 3

The method of forming a gassed emulsion explosive of the current invention was carried out using the following components in aqueous solution, the combination of components having the following composition;

urea 5.0 wt % sodium nitrite 6.9 wt % ammonium sulphate 11.4 wt % water 76.7 wt %

An aqueous solution of sodium nitrite (SNI) and urea was stored in one container of the apparatus of the current invention while an aqueous solution of the ammonium nitrate (AN) and urea was stored in a separate container. The SNI solution and AN/urea solution were pumped from their containers through separate conduits into a small tank and were mixed together using a rapidly turning propeller. The premix so formed was then injected into the water-in-oil emulsion just prior to the water-in-oil emulsion passing through a series of static mixing elements which evenly distributed the components suitable for gas formation throughout the water-in-oil emulsion. The water-in-oil emulsion incorporating the components passed through the remaining length of stainless steel conduit into a flexible loading hose, the other end of which was loaded in a blasthole.

The blasthole was filled with the combinations of water-in-oil emulsion and mixed components. The mixed components started to react after about 30 seconds and it took about 30 minutes for the gassing reaction to be completed. The density of the gassed water-in-oil emulsion was 1.00 g/cc compared with 1.38 g/cc for the ungassed water-in-oil emulsion. The blasthole was detonated successfully.

EXAMPLE 4 the gassing method of the current invention and carried out using the same components for gas formation in the same proportions as described in Example 1. In this example however there was no premixing of the aqueous solution of sodium nitrite (SNI) with the ammonium nitrate (AN)/thiourea solution. The two solutions were directly pumped into the water-in-oil emulsion just prior to the water-in-oil emulsion passing through a series of static mixing elements which evenly distributed the two streams of components throughout the water-in-oil emulsion. The water-in-oil emulsion incorporating the components passed through the remaining length of stainless steel conduit into a flexible loading hose, the other end of which was located in a blasthole.

The blasthole was filled with the combination of water-in-oil emulsion and mixed components. The components started to react after about 30 minutes and it took about 3 hours for the gassing reaction to be completed. The density of the gassed water-in-oil emulsion was 1.14 g/cc compared with 1.38 g/cc for the ungassed water-in-oil emulsion. The blasthole was detonated successfully.

A comparison of the results in Example 1 and Example 4 shows that when the SNI and AN/thiourea were premixed prior to addition to the water-in-oil emulsion, the reaction to form a gas was faster and the final density of the gassed emulsion was much lower than when the SNI solution and the AN/thiourea solution were not premixed before addition to the water-in-oil emulsion.

EXAMPLE 5

The following aqueous components were incorporated into the water-in-oil emulsion of Example 1 in the proportions indicated using the apparatus of the current invention;

| | |
|---|---|
| sodium carbonate | 10.6 wt % |
| acetic acid | 12.0 wt % in an 0.1M soln |
| water | balance |

The level of addition of the components to the water-in-oil emulsion was 0.5 wt %. The apparatus of the current invention was made by construction from scratch. The containers of the apparatus comprised polypropylene or stainless steel tanks.

An aqueous solution of the sodium carbonate was stored in one container of the apparatus of the current invention while an aqueous solution of the acetic acid was stored in a separate container. The water-in-oil emulsion was stored in a large volume stainless steel container and was mechanically pumped from the storage container through a series of stainless steel conduits of the apparatus. The sodium carbonate solution and acetic acid solution were pumped from their containers through separate conduits which eventually joined to form a single conduit. The turbulence caused by the two streams of solution meeting to form a single stream caused thorough mixing of the sodium carbonate and acetic acid. The single stream of mixed components was then pumped into the water-in-oil emulsion just prior to the water-in-oil emulsion passing through a series of static mixing elements which evenly distributed the gasser composition throughout the water-in-oil emulsion. The water-in-oil emulsion incorporating the mixed components took only a few seconds to pass through the remaining length of stainless steel conduit into a flexible loading hose, the other end of which was located in a blasthole.

The blasthole was filled with the combination of water-in-oil emulsion and mixed components. The components started to react immediately and it took about 20 minutes for the gassing reaction to reach completion. The density of the gassed water-in-oil emulsion was 1.10 g/cc compared with 1.38 g/cc for the ungassed water-in-oil emulsion. The blasthole detonated successfully.

While the water-in-oil emulsion gassed using sodium carbonate/acetic acid as components detonated successfully, the density reduction was not as great as for the sodium nitrite/ammonium nitrate components of Example 1. It is assumed that the difference in degree or efficiency of gassing may be due to the greater solubility of carbon dioxide gas in the water-in-oil emulsion.

EXAMPLE 6

The emulsion and components for gas formation of Example 1 was used to load a 30 meter blasthole using the apparatus and method of the current invention. As a blasthole was loaded, the proportion of total components for gas formation added to the emulsion was varied from 0.9 wt % to 0.2 wt % of the emulsion. The emulsion explosive density at the toe of the blasthole was 0.60 g/cc and the density increased constantly along the length of the blasthole so that the density at the collar of the blasthole was 1.12 g/cc. The blasthole was detonated successfully.

EXAMPLE 7

An emulsion explosive composition was formed comprising the emulsion and components for gas formation of Example 1 plus two optional components, and anti-fume liquid and urea solution, the anti-fume liquid and urea solution comprising 15 wt % of the emulsion composition. The anti-fume liquid and urea solution were kept in separate containers and supplied into the emulsion just prior to addition of the components for gas formation. The composition was loaded into 2 blastholes of 32 mm diameter and 10 meters depth. Both blastholes detonated successfully with no fume formation.

EXAMPLE 8

A permitted emulsion explosive composition was formed comprising the emulsion and components for gas formation of Example 1 plus a sodium chloride solution as an optional component. The sodium chloride solution (2.5 wt % of emulsion composition) was supplied into the emulsion at the same point as the components for gas formation. The permitted explosive composition was loaded into 2 underground blastholes of 22 mm diameter and 10 meters depth. Both blastholes detonated successfully with no fume formation.

While the invention has been explained in relation to its preferred embodiments it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A process for the manufacture and delivery of an emulsion explosive comprising:

(i) providing an emulsion;

(ii) supplying from respective containers at least two components which on combination form a gas for gassing said emulsion and optionally other components for the emulsion explosive, wherein the supplying further comprises continuously controlling the amount or rate of supply of said components from the respective containers;

(iii) blending in a mixing means said at least two components and optional other components with the emulsion to form an emulsion explosive in which said components are evenly distributed therethrough;

(iv) delivering the emulsion explosive from said mixing means into a blasthole or package; and (v) varying continuously in a controlled manner the composition of the emulsion explosive to meet differing compositional requirements within blastholes and between blastholes.

2. A process according to claim 1 wherein the mixing means is selected from the group consisting of pinmills, static mixing elements, liquid injection means and combinations thereof.

3. A process according to claim 1 wherein the supplying comprises conveying said components from the containers to the mixing means via a supply means selected from the group consisting of augers, pumps and combinations thereof.

4. A process according to claim 1 wherein controlling the amount or rate of supply of components to the mixing means is used to vary the the density and/or the energy of the emulsion explosive.

5. A process according to claim 1 wherein the optional components are selected from the group consisting of gassing accelerator, gassing catalyst, salt, anti-fume species, species for suppressing reaction, species for suppressing breakdown of the explosive composition, pH buffer, thickening agents, thickener crosslinking agents and combinations thereof.

6. A process according to claim 1 wherein one of the at least two components which react to form a gas for sensitising the emulsion is selected from the group consisting of inorganic nitrite, ammonium species, a mixture of inorganic nitrite plus accelerator, and a mixture of ammonium species plus accelerator.

7. A process according to claim 1 wherein the components which react to form a gas for sensitising the emulsion comprise inorganic nitrite and ammonium species.

8. A process according to claim 1 wherein the at least two components which on combination react to form a gas are premixed prior to blending with the emulsion.

9. A process according to claim 8 wherein the premixing is performed in a mixing chamber or in an area of turbulence formed by the combination of two or more fluid streams of the at least two components.

10. A process according to claim 6 wherein the ammonium species is selected from the group consisting of ammonium chloride, ammonium nitrate, ammonium chlorate, ammonium sulphate, ammonium perchlorate, ammonium thiocyanate and combinations thereof.

11. A process according to claim 6 wherein the nitrite species is selected from the group consisting of alkaline earth nitrite, alkali metal nitrite and combinations thereof.

12. A process according to claim 6 wherein the accelerator is selected from the group consisting of thiourea, thiocyanate, iodide, cyanate, acetate and combinations thereof.

13. A process for the manufacture of an emulsion explosive according to claim 6 wherein each of the at least two components which on combination react to form a gas comprises less than 25 wt % of the total combination.

14. An apparatus for manufacturing and delivering an emulsion explosive, comprising:

(i) at least one mixing means suitable for blending components into an emulsion;

(ii) at least one delivery means for delivering an emulsion explosive from said mixing means into a blasthole or package;

(iii) at least one container for emulsion;

(iv) at least two containers for components which on combination are suitable for forming a gas for the gassing emulsion;

(v) optionally, further containers for optional components suitable for addition to the emulsion or emulsion explosive;

(vi) supply means for the supply of said components from said containers to the mixing means; and (vii) control means for controlling the amount or rate of supply of components to the mixing means and thereby enabling the composition of the emulsion explosive to be continuously varied in a controlled manner.

15. An emulsion explosive manufactured using the process of claim 1.

16. A blasthole loaded with emulsion explosive manufactured according to the process of claim 1.

17. A blasthole loaded with emulsion explosive manufactured according to claim 16 wherein a chemical composition and/or physical property of the emulsion explosive is varied along at least part of the length of the blasthole.

18. A blasthole loaded with emulsion explosive manufactured according to claim 17 wherein the physical property varied is the density and/or energy of the emulsion explosive.

19. Blastholes loaded with emulsion explosives manufactured according to the process of claim 1 wherein the chemical composition and/or physical properties of the emulsion explosive varies between at least two of the blastholes.

20. A packaged explosive comprising a cartridge loaded with emulsion explosive manufactured according to the process of claim 1.

21. A process according to claim 4 wherein the supplying of said components is controlled to produce an emulsion explosive having a first density at the toe of a blasthole to which the emulsion explosive is delivered and a second, higher density at the collar of said blasthole.

22. A process according to claim 21 wherein the supplying of said components is controlled such that the density of the emulsion explosive increases constantly along the length of the blasthole.

23. A process according to claim 5 wherein said supplying and blending steps include supplying and blending urea as one of said optional other components.

24. A blasthole according to claim 18 wherein the emulsion explosive has a first density at the toe of the blasthole and a second higher density at the collar of the blasthole.

25. A blasthole according to claim 24 wherein the density of the emulsion explosive increases constantly along the length of the blasthole.

* * * * *